US009521884B2

(12) United States Patent
Matsuzawa et al.

(10) Patent No.: US 9,521,884 B2
(45) Date of Patent: Dec. 20, 2016

(54) FASTENER CHAIN AND SLIDE FASTENER

(75) Inventors: Shinji Matsuzawa, Toyama (JP); Takuya Shimizu, Toyama (JP); Yusuke Numata, Toyama (JP); Satoshi Kuno, Toyama (JP); Takayuki Hasegawa, Toyama (JP)

(73) Assignee: YKK Corporation (JP)

( * ) Notice: Subject to any disclaimer, the term of this patent is extended or adjusted under 35 U.S.C. 154(b) by 122 days.

(21) Appl. No.: 13/876,395

(22) PCT Filed: Sep. 29, 2010

(86) PCT No.: PCT/JP2010/066892

§ 371 (c)(1),
(2), (4) Date: Mar. 27, 2013

(87) PCT Pub. No.: WO2012/042605

PCT Pub. Date: Apr. 5, 2012

(65) Prior Publication Data

US 2013/0185903 A1 Jul. 25, 2013

(51) Int. Cl.
*A44B 19/34* (2006.01)
*D03D 15/12* (2006.01)
(Continued)

(52) U.S. Cl.
CPC ..... *A44B 19/346* (2013.01); *D03D 15/12* (2013.01); *A41D 31/0022* (2013.01);
(Continued)

(58) Field of Classification Search
CPC . A44B 19/346; Y10T 24/252; Y10T 24/2521; Y10T 24/2529; Y10T 24/253; A41D 31/0022; D10B 2401/063; D10B 2501/0631; D03D 15/12; A62B 17/003
(Continued)

(56) References Cited

U.S. PATENT DOCUMENTS 4,365,655 A * 12/1982 Feinberg ..... 139/426 R
5,713,601 A 2/1998 Bonigk
(Continued)

FOREIGN PATENT DOCUMENTS

JP 9-109828 A 4/1997
JP 2002-65319 A 3/2002
(Continued)

OTHER PUBLICATIONS

Translation—JP 2002065319 A, Yoshiyuki Kino, pp. 1-18.*
International Search Report, PCT Application No. PCT/JP2010/066892, mailed Dec. 28, 2010.

*Primary Examiner* — Abigail Morrell
(74) *Attorney, Agent, or Firm* — Kilpatrick Townsend & Stockton LLP

(57) ABSTRACT

In a fastener chain, at least some warps constituting a woven fastener tape are provided with a flame retardant phosphorus-copolymerized polyester fiber and wefts constituting the same fastener tape are provided with a synthetic fiber that is not phosphorus-copolymerized and that has a higher degree of tensile strength than the flame retardant polyester fiber. With this configuration, superior flame retardancy can be stably obtained and there is no variance in the flame retardancy of the fastener chains. In the fastener chain, the heat contraction of the warp is used to improve the chain horizontal pull force, and by increasing the frictional resistance between the warp and the weft, shifting of the weave pattern of the fastener tape can be prevented. Further, the fastener chain can be provided at a low cost because of the small amount of flame retardant polyester fiber used.

8 Claims, 3 Drawing Sheets

(51) Int. Cl.
*A62B 17/00* (2006.01)
*A41D 31/00* (2006.01)

(52) U.S. Cl.
CPC ..... *A62B 17/003* (2013.01); *D10B 2401/063* (2013.01); *D10B 2501/0631* (2013.01); *Y10T 24/2561* (2015.01)

(58) Field of Classification Search
USPC 442/199, 216, 301, 208, 209, 217; 428/920, 428/921; 24/392, 393, 397, 398; 139/420 R, 426 R, 420 A
See application file for complete search history.

(56) References Cited

U.S. PATENT DOCUMENTS

| | | | | |
|---|---|---|---|---|
| 2001/0009832 | A1* | 7/2001 | Shaffer et al. ..... | 442/181 |
| 2003/0228821 | A1* | 12/2003 | Zhu et al. ..... | 442/197 |
| 2005/0235466 | A1 | 10/2005 | Segawa et al. | |

FOREIGN PATENT DOCUMENTS

| | | | |
|---|---|---|---|
| JP | 2002-69797 | A | 3/2002 |
| JP | 2004-16688 | A | 1/2004 |
| JP | 2009-242953 | A | 10/2009 |

* cited by examiner

FASTENER CHAIN AND SLIDE FASTENER

This application is a national stage application of PCT/JP2010/066892 which is incorporated herein by reference.

TECHNICAL FIELD

The invention relates to a fastener chain having a woven flame retardant fastener tape and a slide fastener having the fastener chain.

BACKGROUND ART

In recent years, in a field such as an automobile, a train, or an airplane, seats or chairs disposed in a vehicle or an airframe are required to have flame retardancy in order to prevent burning in fire. Further, flame retardancy is required in some cases in clothes such as a work suit or indoor furnishing goods such as chairs or curtains used for interior accessories.

A fiber product requiring the flame retardancy is configured by using a fiber having heat resistance or flame retardancy or after a woven fabric or a knitted fabric is fabricated by using a general fiber, the fiber product is configured by applying a flame retardant to the woven fabric or the knitted fabric.

Further, when a slide fastener is used in the fiber product, the flame retardancy is required for even the slide fastener. As a result, in order to acquire the flame retardancy in the slide fastener in the related art, the flame retardant was generally applied to a fastener element or a fastener tape of the slide fastener.

However, in recent years, the flame retardancy of the slide fastener is required to be further improved with respect to products in some fields such as an automobile or an airplane. Further, when the flame retardancy is acquired by applying the flame retardant to a slide fastener as described above, for example, when strong dry cleaning and the like are repeatedly performed with respect to a fastener attached product attached with the slide fastener, the flame retardant is gradually separated from the slide fastener and flame retardancy of the slide fastener may deteriorate with time.

Further, when the flame retardant is attached to the slide fastener, there are many cases in which dyeing processing is performed with a dye containing the flame retardant in a dyeing process of the fastener tape or the fastener element. However, when the dye contains the flame retardant, a level dyeing property of the dye in the dyeing processing deteriorates, and as a result, color shading is generated in the fastener tape or the fastener element and it is very difficult to uniformly attach the flame retardant, and nonuniformity occurs in the flame retardancy of each slide fastener, which is acquired.

In regard to this problem, for example, JP 2002-65319 A (Patent Document 1) discloses a slide fastener in which a fastener tape is configured by using a polyester fiber containing phosphorus at a predetermined ratio. When the slide fastener disclosed in Patent Document 1 will be described in detail, the slide fastener has a pair of left and right fastener tapes and fastener elements stuck to facing side edge portions of the fastener tapes, respectively.

In this case, as the fastener tape, a woven fabric or a knitted fabric acquired by weaving or knitting the polyester fiber containing phosphorus to polyester at 3000 to 20000 ppm or a non-woven fabric of the polyester fiber containing phosphorus to polyester at 3000 to 20000 ppm may be used. In particular, in the embodiment of Patent Document 1, the fastener tape is configured by the woven fabric woven by using a polyester false-twist textured yarn (167 dtex/48f) containing phosphorus at 7000 ppm in a warp or a weft.

Further, as the fastener element, various types of elements such as an injection type fastener element fixed to the fastener tape by injection-molding a synthetic resin or a linear (continuum) fastener element sewn to the fastener tape by forming a monofilament in a coil shape or a zigzag shape may be used.

In particular, in the embodiment of Patent Document 1, a coil-shaped fastener element made of a polyester resin containing phosphorus whose content is 7000 ppm is sewn to the fastener tape by using a stitching thread or a core thread. In this case, the stitching thread and the core thread are also configured by the polyester resin containing phosphorus whose content is 7000 ppm.

Further, in another embodiment of Patent Document 1, a slide fastener is also disclosed, in which only a fastener tape has flame retardancy by using the polyester fiber containing phosphorus in a warp and a weft of the fastener tape while a fastener element, a stitching thread, and a core thread are configured by a general polyester resin or fiber not containing phosphorus.

As such, since the fastener tape in the slide fastener of Patent Document 1 is configured by using a polyester fiber containing phosphorus to polyester at 3000 to 20000 ppm, the slide fastener may have high flame retardancy to pass a flammability test (for example, a flammability test method of an interior material of an automobile, FMVSS No. 302 (JIS D1201)) stipulated in various industrial fields by action of phosphorus.

Further, according to Patent Document 1, since a compound containing phosphorus is selected and used, there is no concern in that toxic halogen-based gas will be generated in combustion or dioxin which becomes a problem in an earth environment will be generated, and as a result, a slide fastener which can be safely used can be provided.

In addition, in the fastener tape of Patent Document 1, as means for containing phosphorus in the polyester fiber at 3000 to 20000 ppm, a method of copolymerizing phosphorus to the polyester resin at the time of fabricating the polyester resin and a method of performing dyeing processing with dye containing a phosphorus compound as the flame retardant in dyeing the fastener tape and the like are disclosed.

In this case, by using a method of copolymerizing phosphorus in the polyester resin at the time of fabricating the polyester resin, the slide fastener can have flame retardancy which is excellent in washing durability and flame retardancy can be prevented from deteriorating even when dry cleaning and the like are repeatedly performed with respect to the slide fastener as compared with, for example, a case in which a method that a phosphorus compound is applied as the flame retardant in dyeing is used.

PRIOR ART DOCUMENT

Patent Document

Patent Document 1: JP 2002-65319 A

SUMMARY OF THE INVENTION

Problem to be Solved by the Invention

In the slide fastener disclosed in Patent Document 1, a flame retardant polyester fiber configured by copolymerizing phosphorus to a polyester resin at a predetermined ratio is used for all yarns constituting the fastener tape as described above in order to acquire excellent flame retardancy. Further, as a flame retardant fiber, a fiber, which contains halogen, is also considered, but a flame retardant polyester fiber configured by copolymerizing phosphorus is used because the flame retardant fiber containing halogen generates toxic halogen-based gas in combustion.

Further, since it is assumed that the slide fastener having flame retardancy is used in seats of an automobile or an airplane, clothes, indoor finished goods, or the like, the slide fastener is also required to have the same fastener performance (for example, a chain horizontal pull force and the like) as a general slide fastener in which the fastener tape is configured by using a general polyester fiber (hereinafter, a general polyester fiber is referred to as a "non-flame retardant polyester fiber").

However, in general, it is known that the flame retardant polyester fiber configured by copolymerizing phosphorus to the polyester resin, is lower in tensile strength and further, more expensive than the non-flame retardant polyester fiber which is not phosphorus-copolymerized.

For this reason, the slide fastener of Patent Document 1 in which the flame retardant polyester fiber is used in all constituent yarns of the fastener tape has a disadvantage in that a tape strength of the fastener tape is decreased, and thus the life-span of the slide fastener is shortened while a manufacturing cost is significantly increased as compared with the general slide fastener.

Further, in the slide fastener of Patent Document 1, when left and right fastener tapes are pulled to be separated from each other while the left and right fastener elements are coupled to each other, the flame retardant polyester fiber configuring the fastener tape is released or cut, and as a result, the left and right fastener elements are easily decoupled from each other (a so-called chain crack easily occurs). Therefore, there was also a problem in that a chain horizontal pull force which is one of the most important items of the fastener performance is decreased.

In view of the problem of the related art, the invention has been made in an effort to provide a fastener chain that has flame retardancy, can prevent a chain from cracking as well as endure a long-time use by preventing the tape strength of the fastener tape from being decreased, and can be provided to be more inexpensive than the related art, and a slide fastener having the fastener chain.

Means for Solving the Problems

In order to achieve the object, as a basic configuration, a fastener chain provided by the invention in which a continuous fastener element is attached to facing tape side edge portions of a pair of left and right woven fastener tapes is characterized in that a flame retardant phosphorus-copolymerized polyester fiber is configured in at least some of warps constituting the fastener tape, and a synthetic resin having a higher tensile strength than the flame retardant polyester fiber, which is not phosphorus-copolymerized, is configured in wefts constituting the fastener tape.

In the fastener chain according to the invention, the flame retardant polyester fiber is preferably configured at a ratio of 50% or more to 100% or less of the warps. Further, the flame retardant polyester fibers are preferably disposed in a tape width direction at a regular interval. In addition, the flame retardant polyester fiber preferably has a thicker line diameter than the weft.

Further, in the fastener chain according to the invention, the weft preferably has a tensile strength of 3.5 cN/dtex or more.

In addition, in the fastener chain according to the invention, the fastener element is preferably made of a flame retardant phosphorus-copolymerized synthetic resin. In addition, a flame retardant containing phosphorus is preferably attached to the fastener tape and the fastener element.

Further, according to the invention, there is provided a slide fastener including the fastener chain having the aforementioned configuration.

Effect of the Invention

In the fastener chain according to the invention, the flame retardant phosphorus-copolymerized polyester fiber is configured in at least some of the warps of the woven fastener tapes and a synthetic fiber having a higher tensile strength than the flame retardant polyester fiber, which is not phosphorus-copolymerized, is configured in the weft of the fastener tapes.

In the fastener chain of the invention, the flame retardant polyester fiber is configured in the warp. In this case, the flame retardant polyester fiber is configured by copolymerizing a monomer containing phosphorus with polyester and is combusted when contacting a flame and heat source such as flame and the like but naturally extinguished through prevention of combustion by action of phosphorus when being separated from the flame and heat source. Further, as a flame retardant fiber, a fiber, which contains halogen, is also considered, but a flame retardant polyester fiber configured by copolymerizing phosphorus is used as the flame retardant fiber in the invention in that the flame retardant fiber containing halogen generates toxic halogen-based gas in combustion as described above.

Therefore, the fastener chain of the invention, in which the flame retardant polyester fiber is configured in the warp, can stably have high flame retardancy capable of passing a flammability test (for example, a flammability test method of an interior material of an automobile, FMVSS No. 302 (JIS D1201)) stipulated in various industrial fields.

Further, in the flame retardant polyester fiber of the invention, since phosphorus is copolymerized, for example, even when strong dry cleaning and the like are performed, phosphorus is not separated from the flame retardant polyester fiber and the flame retardancy can be maintained for a long term.

In addition for example, when a flame retardant is attached to a slide fastener as the flame retardant is contained in the dye at the time of dyeing the slide fastener in the related art, there are problems in that it is difficult to uniformly attach the flame retardant to the fastener tape and the like as described above and nonuniformity occurs inflame retardancy of the slide fastener. In this regard, when the flame retardant slide fastener is configured by using the flame retardant polyester fiber as in the invention, any slide fasteners may also stably have the same flame retardancy, thereby preventing occurrence of nonuniformity in flame retardancy.

Furthermore, the fastener chain of the invention, a synthetic resin having the higher tensile strength than the flame retardant polyester fiber is configured in the weft of the fastener tape. As a result, the fastener tape of the fastener chain becomes higher in tape strength or abrasion-resistance and can stably endure even a long-term use. Further, even when the fastener tape is tensioned in the tape width direction, it is difficult for the weft to be released or cut as compared with the case in which the flame retardant polyester fiber is used in the weft of the fastener tape as in Patent Document 1. As a result, for example, even when the left and right fastener tapes are tensioned to be separated from each other while the left and right fastener elements are coupled to each other, it is difficult for chain cracking to occur, thereby certainly improving the chain horizontal pull force.

In particular, it is known that the flame retardant phosphorus-copolymerized polyester fiber is lower in tensile strength of the fiber itself and more expensive as described above and larger in dry-heat contraction ratio than, for example, the general polyester fiber (non-flame retardant polyester fiber) which is not phosphorus-copolymerized. The reason why the dry-heat contraction ratio of the flame retardant polyester fiber increases is considered as follows.

That is, since the flame retardant polyester fiber is acquired by copolymerizing the monomer containing phosphorus in polymerization, it is difficult to increase a polymerization degree like the non-flame retardant polyester fiber and an extension condition or a heating condition is limited, and as a result, the flame retardant polyester fiber has a large dry-heat contraction ratio.

As such, since the flame retardant phosphorus-copolymerized polyester fiber is large in dry-heat contraction ratio, when the slide fastener of the invention, in which the flame retardant polyester fiber is configured in the warp of the fastener tape, is subjected to thermosetting at a predetermined temperature in, for example, a manufacturing process of the slide fastener, the warp thermally contracts, and thus the fastener tape can significantly contract in the tape length direction. As a result, in the fastener chain, the density of wefts can be increased by increasing the number of wefts per unit length in the tape length direction of the fastener tape.

As such, the fastener tape contracts in the tape length direction such that the density of wefts is increased, thereby further increasing the tape strength of the fastener tape (particularly, the strength of the tape to the tension of the tape width direction). Further, with contraction of the fastener tape, since the interval between the coupling heads of the fastener elements is narrowed, the coupling strength between the left and right fastener elements can be easily increased. As a result, in the fastener chain of the invention, the chain horizontal pull force can be further improved, and for example, the fastener chain can have a higher chain horizontal pull force by 10% or more than the fastener chain in the related art, in which the flame retardant polyester fiber is used in all constituent yarns of the fastener tape as in Patent Document 1.

In addition, in the fastener chain of the invention, the density of wefts is increased as described above, and thus the frictional resistance between the warp and the weft may be increased, and as a result, for example, when the fastener tape is sewn, shifting of a weave pattern of the fastener tape can be effectively prevented.

For example, in the case where the weave pattern of the fastener tape is shifted, when the fastener tape receives tensile stress, the tensile stress is easily locally concentrated and causes the warp or the weft to be released or cut in some cases, but in the fastener chain of the invention, it is difficult for the weave pattern in the fastener tape to be shifted and even when the fastener tape receives the tensile stress, the tensile stress can be prevented from locally concentrating.

In the fastener chain according to the invention, the flame retardant polyester fiber is configured at a ratio of 50% or more to 100% or less of the warps. Herein, the case in which the flame retardant polyester fiber is configured at the ratio of 50% or more of the warps means the case in which the flame retardant polyester fiber is configured at the ratio of one or more per two of the warps and the case in which the flame retardant polyester fiber is configured at the ratio of 100% means the case in which the flame retardant polyester fiber is configured in all warps.

As such, the flame retardant polyester fiber is configured at the ratio of 50% or more of the warps, for example, thereby making the fastener tape have the same flame retardancy as the case in which the flame retardant polyester fiber is used in all constituent yarns of the fastener tape as in Patent Document 1. Further, when thermosetting is performed with respect to the fastener tape, the fastener tape can certainly contract in the tape length direction, and as a result, the chain horizontal pull force of the fastener chain can be stably improved and shifting of the weave pattern can be stably prevented.

Further, when the flame retardant polyester fiber is subjected to dyeing processing because phosphorus is copolymerized, the flame retardant polyester fiber is more easily dyed than the non-flame retardant polyester fiber. In this case, when the flame retardant polyester fiber is configured at the ratio of 50% or more of the warps of the fastener tape, even when the flame retardant polyester fiber is dyed more thickly than other synthetic fibers, a color of the flame retardant polyester fiber is primarily expressed in the fastener tape and it is possible to make color shading (color shading shape) which occurs in the fastener tape inconspicuous.

Meanwhile, the flame retardant polyester fiber is configured at the ratio of 100% or less of the warps to prevent a manufacturing cost of the fastener chain from increasing and the chain horizontal pull force of the fastener chain can be prevented from decreasing because the flame retardant polyester fiber itself is low in tensile strength.

In the fastener chain according to the invention, the flame retardant polyester fibers are disposed in the tape width direction at a regular interval. As a result, flame retardancy may be uniform throughout the fastener tape. Further, when the fastener chain is dyed, it is possible to make the color shading (color shading shape) which occurs in the fastener tape inconspicuous.

Further, in the fastener chain of the invention, the flame retardant polyester fiber has a larger line diameter than the weft. As a result, the tensile strength of the flame retardant polyester fiber is increased to further improve the tape strength of the fastener tape.

In addition, the weft has a tensile strength of 3.5 cN/dtex or more and preferably 4.0 cN/dtex or more. Accordingly, since it is difficult for the weft to be released or cut when the fastener tape is tensioned in the tape width direction, the chain horizontal pull force can be certainly improved.

Further, in the fastener chain of the invention, the fastener element is made of a flame retardant phosphorus-copolymerized synthetic resin. Further, the flame retardant containing phosphorus is attached to the fastener tape and the fastener element. Accordingly, the flame retardancy of the fastener chain can be further increased.

In addition, the slide fastener of the invention, which has the fastener chain having the above configuration, has stably the flame retardancy capable of passing the flammability test stipulated in various industrial fields for a long term and can be provided more inexpensively than a slide fastener in the related art (for example, the slide fastener of Patent Document 1) having flame retardancy.

Further, the tape strength or abrasion resistance of the fastener tape is increased and the slide fastener of the invention can stably endure a long-term use, and for example, when the fastener tape is sewn, shifting of a weave pattern of the fastener tape can be effectively prevented. In addition, the slide fastener of the invention can stably have a higher chain horizontal pull force than the slide fastener in the related art having flame retardancy

MODE FOR CARRYING OUT THE INVENTION

Hereinafter, appropriate embodiments of the invention will be described in detail with reference to the accompanying drawings. Further, the invention is not limited to embodiments described below at all and embodiments having the substantially same configuration and further, the same operational effect as the invention can be variously changed.

For example, in the following embodiments, a fastener chain in which fastener elements which are continuous in a coil shape are sewn to a tape side edge portion of a fastener tape will be described. However, the invention is not limited thereto and for example, a fastener chain may be configured, in which fastener elements having a zigzag shape are sewn to the tape side edge portion of the fastener tape.

Further, in the embodiments described below, a standard type slide fastener in which a fastener element is attached to a tape side edge portion of a flat fastener tape will be described, but in the invention, a type of the slide fastener is not particularly limited and the invention may be appropriately applied to, for example, even a so-called concealed type slide fastener configured in such a manner that the fastener tape is bent in a U shape.

Figure 1:
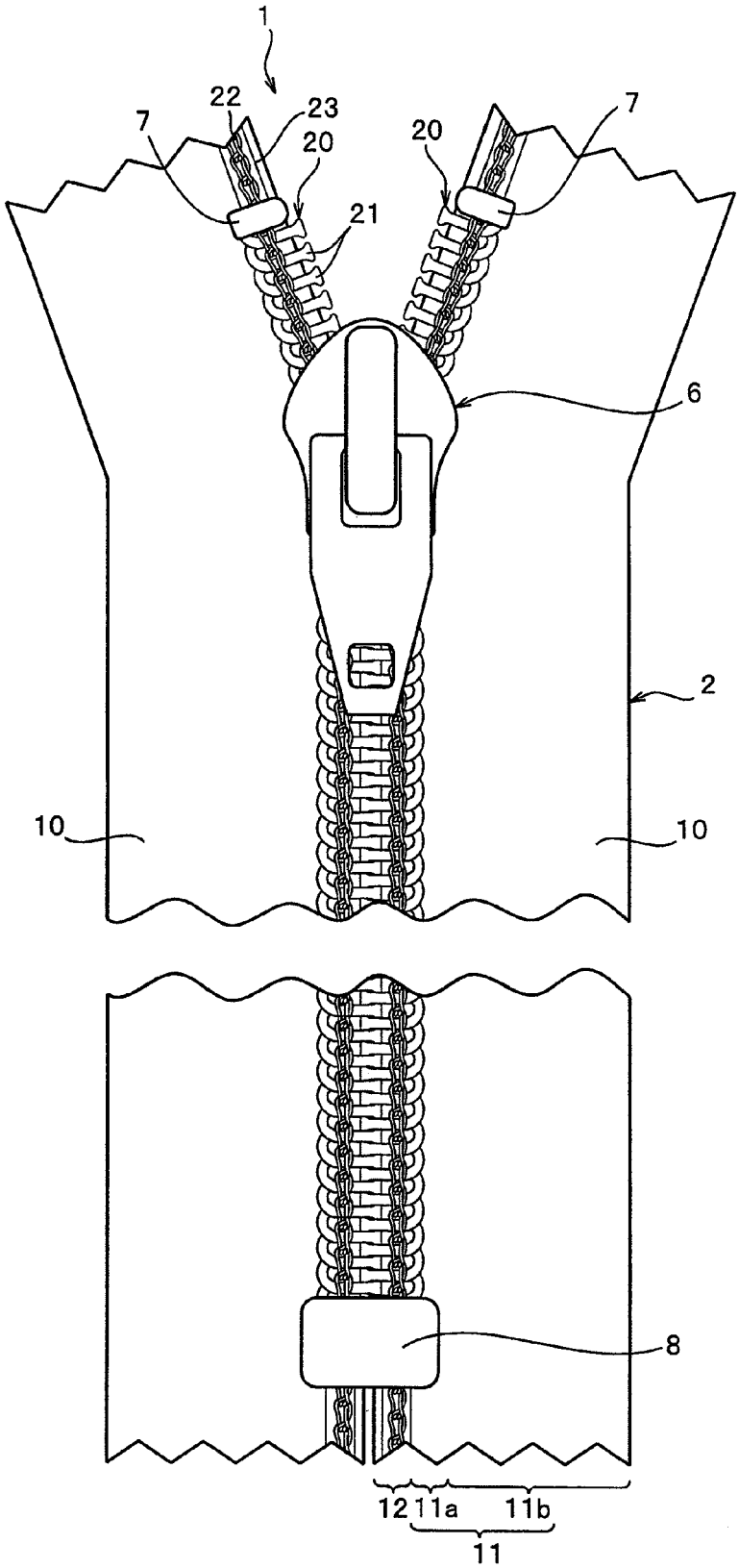
FIG. 1 is a front view illustrating a slide fastener having a fastener chain according to an embodiment of the invention.
Figure 2:
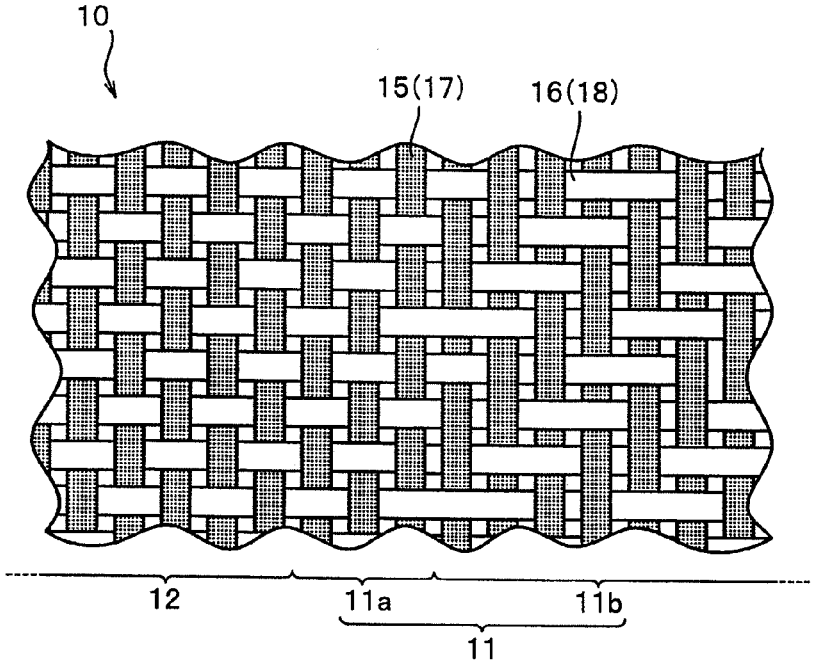
FIG. 2 is a diagram schematically illustrating a woven fabric structure of a part of a fastener tape in the fastener chain.

FIG. 1 is a front view illustrating a slide fastener having a fastener chain according to a first embodiment. Further, FIG. 2 is a diagram schematically illustrating a woven fabric structure of a part of a fastener tape in the fastener chain.

Further, in the following description, a front-back direction indicates a length direction of the fastener tape and is the same direction as a sliding direction in which a slider slides. In addition, a left-right direction indicates a tape width direction of the fastener tape and indicates a direction which is parallel to a tape surface of the fastener tape and orthogonal to the length direction of the tape. Furthermore, an up-down direction indicates a tape front-back direction orthogonal to the tape surface of the fastener tape, and in particular, a direction of a side where the fastener elements are attached to the fastener tape is defined as an upper side and a direction opposite to the side is defined as a lower side.

A slider 6 is attached to a fastener chain 2 according to a first embodiment as illustrated in FIG. 1 to configure a standard type slide fastener 1. In this case, the slide fastener 1 illustrated in FIG. 1 includes the fastener chain 2 according to the first embodiment, an upper stopper 7 fixed to one end of an element row 20 of the fastener chain 2, a lower stopper 8 fixed to the other end of the element row 20 of the fastener chain 2, and the slider 6 attached slidably along the element row 20.

The slide fastener 1 is configured such that the slider 6 slides toward the upper stopper 7 side (in a front direction), and as a result, the left and right element rows 20 are coupled to each other to close the slide fastener 1 and the slider 6 slides toward the lower stopper 8 side (in a back direction), and as a result, the left and right element rows 20 are separated from each other to open the slide fastener 1. Further, the upper stopper 7, the lower stopper 8, and the slider 6 in the slide fastener 1 are configured similarly to those generally used in the related art.

The fastener chain 2 of the first embodiment, which configures the slide fastener 1, includes a pair of left and right fastener tapes 10 woven in a narrow shape and the element rows 20 disposed along facing tape side edge portions 12 of fastener tapes 10, and the element row 20 is configured such that a continuous-shape fastener element 21 is sewn to the fastener tape 10 by using a stitching thread 22.

The fastener tape 10 in the first embodiment is configured by a narrow band form woven by a warp 15 disposed in the length direction of the tape and a weft 16 disposed in the width direction of the tape. The fastener tape 10 in the invention is fabricated in such a manner that multifilament threads constituted by a plurality of filaments are used in the warp 15 and the weft 16 and needle-woven by double picks of the weft 16. Further, the double-pick weft 16 is inserted as one group with two threads while one yarn reciprocates to be doubled, and thus two yarns are provided. As a result, one fastener tape 10 is woven by one weft 16 and a plurality of warps 15. Further, in FIGS. 2 and 3, yarns constituted by one group with two yarns, which are inserted and doubled, are expressed as one weft 16 for simply expressing the drawings.

The fastener tape 10 includes a tape main body 11 which is a part sewn to a fastener attached product such as a seat cover or clothes and a tape side edge portion 12 (may also be called an element attached portion) which is disposed at one edge side of the tape main body 11 and to which the fastener element 21 is attached. Further, the tape main body 11 includes a first main body area 11*a* which becomes an area which a flange portion of the slider 6 passes through when the slider 6 slides and a second main body area 11*b* which becomes an area to express a texture of the fastener tape 10.

In this case, the tape side edge portion 12 in the fastener tape 10 and the first main body area 11*a* of the tape main body 11 are woven in a plain-woven structure, whereas the second main body area 11*b* of the tape main body 11 is woven in a twill woven structure. Further, in the invention, a woven fabric structure of the fastener tape 10 is not particularly limited, but may be appropriately changed.

In the first embodiment, a flame retardant polyester fiber 17 configured by copolymerizing monomer containing phosphorus with polyester is configured in all of the warps 15 constituting the fastener tape 10 (in FIG. 2, a thread having a color) and a general polyester fiber (non-flame retardant polyester fiber) 18 which is not phosphorus-copolymerized is configured in all of the wefts 16 constituting the fastener tape 10 (in FIG. 2, a white thread). Further, the warp 15 and the weft 16 are formed by the multifilament threads, but in the invention, the warp 15 and the weft 16 may also be formed by a monofilament thread.

Herein, the flame retardant phosphorus-copolymerized polyester fiber 17 is more easily dyed than the non-flame retardant polyester fiber 18 which is not phosphorus-copolymerized, but when the flame retardant polyester fiber 17 is configured in all of the warps 15 constituting the fastener tape 10 as in the first embodiment, it is possible to make color shading (color shading shape) to be generated in the fastener tape 10 inconspicuous, for example, even when dyeing processing is performed in the fastener chain 2 of the first embodiment and to improve visual quality (external appearance quality) of the fastener chain 2 or the slide fastener 1.

Further, in the first embodiment, a content of phosphorus (content of a phosphorus atom) in the flame retardant polyester fiber 17 itself is set to 5800 ppm. As a result, like the fastener tape 10 of the embodiment, in the case where the flame retardant polyester fiber 17 is configured only in the warp 15 and the non-flame retardant polyester fiber 18 which is not phosphorus-copolymerized is configured in the weft 16, the content of phosphorus in the fastener tape 10 is approximately 2900 ppm which is approximately a half of the content of phosphorus in the flame retardant polyester fiber 17.

Further, in the invention, the content of phosphorus in the flame retardant polyester fiber 17 itself is preferably set to 3000 ppm or more to 20000 ppm or less and the content of phosphorus in the fastener tape 10 is preferably set to 700 ppm or more to 10000 ppm or less and particular preferably to 1000 ppm or more to 5000 ppm or less. The reason is that when the content of phosphorus in the flame retardant polyester fiber 17 or the fastener tape 10 is too small, desired flame retardancy may not be stably acquired, while when the content of phosphorus in the flame retardant polyester fiber 17 or the fastener tape 10 is too large, a fiber strength or a tape strength may significantly deteriorate.

In this case, the flame retardant polyester fiber 17 configured in the warp 15 is constituted by the multifilaments, but phosphorus-copolymerized filaments at a predetermined ratio are twisted to each other to configure the flame retardant polyester fiber 17 or a phosphorus-copolymerized filament and a filament which is not phosphorus-copolymerized are twisted to each other at a predetermined ratio to configure the flame retardant polyester fiber 17, in order to set the content of phosphorus in the flame retardant polyester fiber 17 itself within the range.

Further, in the first embodiment, the flame retardant polyester fiber 17 configured in the warp 15 may be configured in such a manner that phosphorus is copolymerized to a main chain of polyester or phosphorus is copolymerized to a side chain of polyester. In addition, the flame retardant polyester fiber 17 has a tensile strength of approximately 3.3 cN/dtex to 3.8 cN/dtex and for example, when 180° C. thermosetting is performed in the fastener chain 2, the flame retardant polyester fiber 17 has a dry-heat contraction ratio of 14% to 15%.

Meanwhile, as the non-flame retardant polyester fiber 18 configured in the weft 16, a general polyester fiber which has been generally known conventionally may be used. The non-flame retardant polyester fiber 18 has a higher tensile strength than that of the flame retardant polyester fiber 17 of the warp 15, and particularly, has a tensile strength of 3.5 cN/dtex or more and preferably a tensile strength of 4.0 cN/dtex or more. Further, for example, when 180° C. thermosetting is performed in the fastener chain 2, the non-flame retardant polyester fiber 18 has a dry-heat contraction ratio of 7% to 8%.

Further, upper limits of tensile strengths of the flame retardant polyester fiber 17 of the warp 15 and the non-flame retardant polyester fiber 18 of the weft 16 are not particularly limited, but at present, the tensile strength of the flame retardant phosphorus-copolymerized polyester fiber 17 is generally less than 4.0 cN/dtex and the tensile strength of the non-flame retardant polyester fiber 18 is generally less than 6.0 cN/dtex.

Further, in the invention, a material of a synthetic fiber configured in the weft 16 is not particularly limited, but may be appropriately changed. Further, the magnitudes of the tensile strengths and the dry-heat contraction ratios of the flame retardant polyester fiber 17 configured in the warp 15 and the synthetic fiber configured in the weft 16 are not particularly limited unless tensile strength of the synthetic fiber configured in the weft 16 is equal to or smaller than that of the flame retardant polyester fiber 17 configured in the warp 15.

In the fastener tape 10 of the first embodiment, for example, when 180° C. thermosetting is performed, the flame retardant polyester fiber 17 of the warp 15 contracts more largely than the non-flame retardant polyester fiber 18 of the weft 16 as described above. As a result, the fastener tape 10 after thermosetting contracts relatively largely in the length direction of the tape, the number of wefts 16 per unit length may be increased in the tape length direction of the fastener tape 10 and the density of the wefts 16 may be increased as compared with the case before thermosetting.

In this case, in the fastener chain 2 of the first embodiment, a weight ratio of the warp 15 and the weft 16 configured per unit area in the fastener tape 10 after heat contraction becomes the warp 15:the weft 16=50.8:49.2. Further, in the invention, a weight ratio of the warp 15 configured per unit area after the warp 15 and the weft 16 of the fastener tape 10 thermally contract is preferably in the range of 25% or more to 52% or less by considering a relationship between the flame retardancy and the tape strength of the fastener tape 10.

Further, in general, since a line diameter of the synthetic resin increases as the synthetic resin largely thermally contracts, for example, in the case where the flame retardant polyester fiber 17 and the non-flame retardant polyester fiber 18 have the same line diameter at the time when the fastener tape 10 is woven, the flame retardant polyester fiber 17 after heat contraction has a larger line diameter than that of the non-flame retardant polyester fiber 18 after heat contraction. The line diameter may be expressed as dtex (decitex) which is a weight per unit length of the thread and a thread having a large line diameter is larger in numerical value of the decitex than a thread having a small line diameter.

In the fastener chain 2 of the first embodiment, the flame retardant polyester fiber 17 thermally contracts, and thus the density of the wefts 16 increases and the flame retardant polyester fiber 17 after heat contraction is formed to be thicker than the non-flame retardant polyester fiber 18 after heat contraction, thereby certainly improving the tape strength or abrasion-resistance of the fastener tape 10.

Subsequently, the fastener element 21 in the first embodiment has the continuous coil shape and is configured by a phosphorus-copolymerized polyester resin. In this case, the content of phosphorus in the fastener element 21 is set to 3000 ppm or more to 20000 ppm or less.

The coil-shaped fastener element 21 is molded in such a manner that, for example, the monofilament made of the phosphorus-copolymerized polyester resin is pressurized at a predetermined interval to form a protruded coupling head and thereafter, wound in a coil shape. Further, the material of the fastener element 21 in the invention is not particularly limited and for example, the fastener element 21 may also be configured by using a synthetic resin such as a general polyester resin which is not phosphorus-copolymerized or a polyamide resin.

Further, the fastener element 21 includes a coupling head formed to extend in a front-back direction (the length direction of the fastener tape 10), a pair of upper and lower legs that extend from the coupling head, and a connection section connecting an edge of the upper leg or the lower leg and the lower leg or the upper leg of the fastener element 21 which are adjacent in the front-back direction.

In the first embodiment, in the coil-shaped fastener element 21, while a core thread 23 is inserted between the upper and lower legs, the coupling head protrudes from the side end edge of the fastener tape 10 to be sewn to the fastener tape 10 by double circular sewing of the stitching thread 22, and as a result, the element row 20 is configured. Further, in the invention, the element row 20 may also be configured by sewing the fastener element 21 to the fastener tape 10 without the core thread 23.

Further, for example, when the fastener chain 2 in which the fastener element 21 is sewn to the fastener tape 10 is subjected to 180° C. thermosetting, the fastener tape 10 thermally contracts in the length direction of the tape as described above, and thus an interval between the coupling heads of the fastener elements 21 which are adjacent in the length direction of the tape may be narrowed in the respective left and right element rows 20. As a result, the left and right fastener elements 21 may be strongly coupled to each other and a coupling strength of the fastener elements 21 may be increased.

In the fastener chain 2 (alternatively, the slide fastener 1 having the fastener chain 2) of the first embodiment configured as above, since the flame retardant polyester fiber 17 is configured in all of the warps 15 of the fastener tape 10 and the fastener element 21 is configured by the phosphorus-copolymerized polyester resin, flame retardancy capable of passing various flammability tests may be stably acquired. Further, even when the fastener chain 2 of the first embodiment is mass-produced, nonuniformity does not occur in flame retardancy of each fastener chain 2.

Further, the flame retardancy of the fastener chain 2 is acquired by copolymerizing phosphorus with the warp 15 and the polyester resin of the fastener element 21 and thus may not deteriorate even when, for example, strong dry cleaning and the like are performed and predetermined flame retardancy may be stably maintained for a long term.

In addition, the non-flame retardant polyester fiber 18 of which a manufacturing cost is lower than that of the flame retardant polyester fiber 17 is configured in the weft 16 of the fastener tape 10. As a result, the fastener chain 2 may be provided inexpensively by suppressing a used amount of the flame retardant polyester fiber 17 while maintaining sufficient flame retardancy as compared with the fastener chain in the related art such as, for example, Patent Document 1 in which the flame retardant polyester fiber is used in all constituent yarns of the fastener tape.

Further, in the fastener chain 2, it is difficult for the weft 16 or the warp 15 of the fastener tape 10 to be released or cut with respect to tensile stress in the width direction of the tape and the tape strength or frictional resistance of the fastener tape 10 is increased. As a result, the fastener chain 2 may be stably used for a long term.

In addition, in the fastener chain 2, since it is difficult for the weft 16 or the warp 15 of the fastener tape 10 to be released or cut and the coupling strength of the fastener element 21 may be increased due to the heat contraction of the flame retardant polyester fiber 17 of the warp, a chain horizontal pull force which is one of the most important items of the fastener performance may be certainly improved.

Further, in the fastener chain 2 of the first embodiment, as described above, the density of the wefts 16 is increased to increase frictional resistance between the warp 15 and the weft 16, and accordingly, even when the fastener tape 10 is sewn for example, shifting of a weave pattern of the fastener tape 10 may be effectively prevented. Accordingly, even when the fastener tape 10 in the fastener chain 2 receives tensile stress and the like, the stress may be prevented from being locally concentrated on a part of the fastener tape 10, and as a result, it may be more difficult for the weft 16 or the warp 15 of the fastener tape 10 to be released or cut.

Further, in the fastener chain 2 according to the first embodiment described above, the flame retardant is attached to the surfaces of the fastener tape 10 and the fastener element 21 to further improve the flame retardancy of the fastener chain 2. In addition, as a method of attaching the flame retardant to the surfaces of the fastener tape 10 and the fastener element 21, a method of performing dyeing processing with a dye containing the flame retardant containing phosphorus may be used in a dyeing process of the fastener chain 2.

In addition, in the fastener chain 2 according to the first embodiment, the flame retardant phosphorus-copolymerized polyester fiber 17 is configured in all of the warps 15 constituting the fastener tape 10, but in the invention, the flame retardant phosphorus-copolymerized polyester fiber 17 may be configured in at least some of the warps 15 constituting the fastener tape 10, and particularly, the flame retardant phosphorus-copolymerized polyester fiber 17 is preferably configured at a ratio (a ratio of one or more per two warps 15) of 50% or more of the warps 15 constituting the fastener tape 10.

Herein, as a second embodiment in the invention, a fastener chain in which the flame retardant polyester fiber is configured at a ratio of 50% (a ratio of one per two) in the warps constituting the fastener tape will be described with reference to FIG. 3. Further, the fastener chain according to the second embodiment basically has the same configuration as the fastener chain according to the first embodiment described above except that the ratio of the flame retardant polyester fiber configured in the warp of the fastener tape is different.

Figure 3:
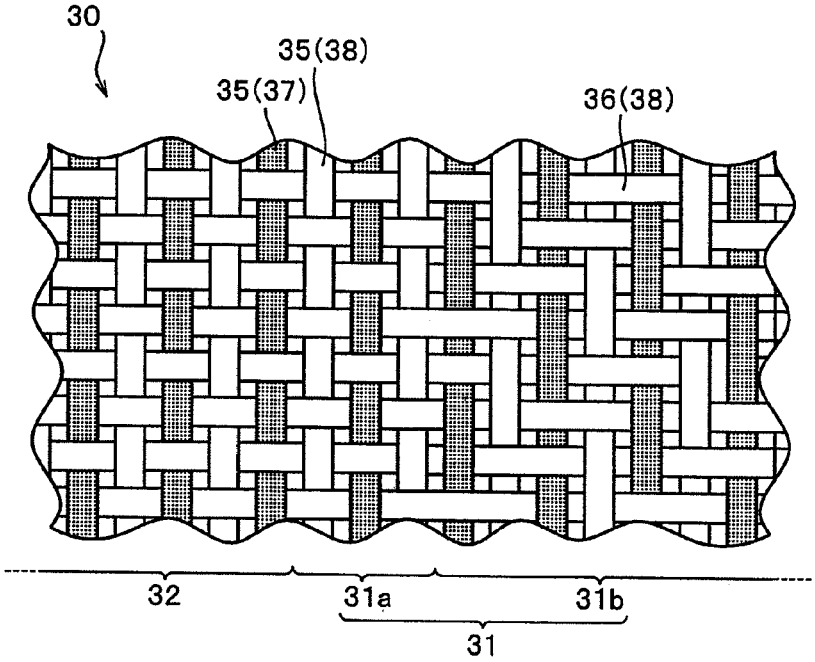
FIG. 3 is a diagram schematically illustrating a woven fabric structure of a part of a fastener tape according to another embodiment of the invention.

A fastener tape 30 of the fastener chain according to the second embodiment is woven by a warp 35 disposed in the length direction of the tape and a weft 36 disposed in the width direction of the tape, and includes a tape main body 31 and a tape side edge portion 32 disposed at the side of one side edge of the tape main body 31 and to which the fastener element is attached, as illustrated in FIG. 3. Further, the tape main body 31 includes a first main body area 31*a* woven in a plain-woven structure and a second main body area 31*b* woven in a twill woven structure.

Further, a non-flame retardant polyester fiber 38 which is not phosphorus-copolymerized is configured in the wefts 36 constituting the fastener tape 30 similarly to the fastener chain according to the first embodiment described above. Meanwhile, a flame retardant phosphorus-copolymerized polyester fiber 37 is configured in a half (50%) of the warps 35 constituting the fastener tape 30 and the non-flame retardant polyester fiber 38 which is not phosphorus-copolymerized is configured in the remaining half (50%).

In particular, in the case of the second embodiment, the flame retardant polyester fiber 37 and the non-flame retardant polyester fiber 38 that are configured in the warps 35 of the fastener tape 30 are alternately configured one by one and the flame retardant polyester fibers 37 are disposed throughout the tape width direction of the fastener tape 30 at a regular interval. As a result, flame retardancy may be uniformly acquired throughout the fastener tape 30.

Further, when the flame retardant polyester fibers 37 are uniformly disposed throughout the tape width direction of the fastener tape 30 as described above, even when the flame retardant polyester fiber 37 is dyed more thickly than the non-flame retardant polyester fiber 38, for example, when the fastener chain is dyed, it is possible to make the color shading generated in the fastener tape 30 inconspicuous.

In addition, in the invention, when the flame retardant polyester fiber 37 is configured in some of the warps 35 of the fastener tape 30, the flame retardant polyester fibers 37 are not uniformly configured as in the second embodiment but may be configured to be locally concentrated. For example, when the slide fastener 1 is attached to the fastener attached product, the flame retardant polyester fiber 37 may also be concentrated on the tape side edge portion 32 in the fastener tape 30 or the first main body area 31*a* of the tape main body 31 such that a tape part exposed to the outside has high flame retardancy.

In this case, the flame retardant polyester fiber 17 configured similarly to the first embodiment is used as the flame retardant polyester fiber 37 configured in a half of the warps 35 of the fastener tape 30 and the non-flame retardant polyester fiber 18 configured similarly to the first embodiment is used as the non-flame retardant polyester fiber 38 configured in the remaining half of the warps 35 of the fastener tape 30 and the non-flame retardant polyester fiber 38 configured in the wefts 36 of the fastener tape 30.

That is, in the second embodiment, a content of phosphorus in the flame retardant polyester fiber 37 itself is set to 5800 ppm similarly to the first embodiment. As a result, in the second embodiment in which the flame retardant polyester fiber 37 is configured at a ratio of 50% in the warps 35 constituting the fastener tape 30, the content of phosphorus in the fastener tape 30 becomes approximately 1450 ppm which is approximately ¼ of the content of phosphorus of the flame retardant polyester fiber 37.

Further, in the fastener chain according to the second embodiment, similarly as the first embodiment, the flame retardant polyester fiber 37 thermally contracts, and thus the density of the wefts 36 is increased and the flame retardant polyester fiber 37 after heat contraction becomes thicker, thereby improving the tape strength or abrasion-resistance of the fastener tape 30.

In the fastener chain according to the second embodiment configured as above, flame retardancy capable of passing various flammability tests may be stably acquired. Further, even when the fastener chain is mass-produced, nonuniformity does not occur in flame retardancy of each fastener chain and for example, even when strong dry cleaning and the like are performed, the flame retardancy may be prevented from deteriorating. Further, in the fastener chain, since the amount of the flame retardant polyester fiber 37 used is smaller than that in the case of the first embodiment, the fastener chain may be provided more inexpensively.

Further, in the fastener chain of the second embodiment, it is difficult for the weft 36 or the warp 35 of the fastener tape 30 to be released or cut similarly to the first embodiment and the coupling strength of the fastener element may be increased due to the heat contraction of the flame retardant polyester fiber 37 configured in the warp, thereby certainly improving the chain horizontal pull force. In addition, the density of the wefts 36 is increased, and thus frictional resistance between the warp 35 and the weft 36 may be increased, thereby effectively preventing shifting of a weave pattern of the fastener tape 30.

EXAMPLES

Hereinafter, examples and comparative examples will be described to describe the invention in more detail, but the invention is not limited thereto.

Herein, in the following Examples 1 to 4 and Comparative Examples 1 and 2, as the flame retardant polyester fiber in which phosphorus was copolymerized, a flame retardant polyester fiber was prepared, in which the content of phosphorus was set to 5800 ppm, a tensile strength was 3.8 cN/dtex, and a dry-heat contraction ratio was 14% when heat-treatment of 180° C. was performed. Further, as the general polyester fiber (non-flame retardant polyester fiber), a polyester fiber was prepared, in which a tensile strength was 4.0 cN/dtex and a dry-heat contraction ratio was 7% when heat treatment of 180° C. was performed. Further, as the fastener element, a fastener element acquired by molding the monofilament made of the polyester resin, in which phosphorus was copolymerized at the content of 5800 ppm, in the coil shape was prepared.

Example 1

A pair of left and right fastener tapes were prepared, in which the flame retardant phosphorus-copolymerized polyester fiber is configured in all warps and the non-flame retardant polyester fiber was configured in the weft and thereafter, the coil-shaped fastener elements were sewn to the facing tape side edge portions of both fastener tapes to manufacture a fastener chain.

Thereafter, 180° C. thermosetting was performed with respect to the manufactured fastener chain to acquire a fastener chain which is a measurement specimen of Example 1. In this case, since a content ratio of the flame retardant polyester fiber to the fastener tape is 50% and the content of phosphorus of the flame retardant polyester fiber is set to 5800 ppm, a content of phosphorus in the fastener tape of Example 1 becomes 2900 ppm.

Herein, the content ratio of the flame retardant polyester fiber disclosed in Examples 1 to 4 is based on a weight ratio of the warp and the weft configured per 1 m of the fastener tape in the fastener tape. In this case, since the pair of left and right fastener tapes are configured, the content ratio may be calculated with respect to only one fastener tape as the specimen.

Example 2

The pair of left and right fastener tapes were prepared, which were provided with the flame retardant polyester fiber uniformly configured at a ratio 75% (a ratio of three per four) and the non-flame retardant polyester fiber configured at a ratio 25% (a ratio of one per four), in the warp, and the non-flame retardant polyester fiber was configured in the weft, and thereafter, the coil-shaped fastener elements were sewn to the facing tape side edge portions of both fastener tapes to manufacture a fastener chain.

Further, in the fastener tape of Example 2, three warps which are adjacent to each other in the width direction of the tape, in which the flame retardant polyester fiber is inserted and one warp in which the non-flame retardant polyester fiber is inserted are repeatedly configured in sequence, and as a result, the flame retardant polyester fibers are disposed at a regular interval in the width direction of the tape at the ratio of three per four.

Thereafter, 180° C. thermosetting was performed with respect to the manufactured fastener chain to acquire a fastener chain which is a measurement specimen of Example 2. In this case, a content ratio of the flame retardant polyester fiber to the fastener tape is 37.5% and a content of phosphorus in the fastener tape of Example 2 is 2175 ppm.

Example 3

The pair of left and right fastener tapes were prepared, which were provided with the flame retardant polyester fiber and the non-flame retardant polyester fiber uniformly configured respectively at a ratio 50% (a ratio of one per two) in the warp, and the non-flame retardant polyester fiber configured in the weft, and thereafter, the coil-shaped fastener elements were sewn to the facing tape side edge portions of both fastener tapes, and as a result, the fastener chain was manufactured.

Thereafter, 180° C. thermosetting was performed with respect to the manufactured fastener chain to acquire a fastener chain which is a measurement specimen of Example 3. In this case, a content ratio of the flame retardant polyester fiber to the fastener tape is 25% and a content of phosphorus in the fastener tape of Example 3 is 1450 ppm.

Example 4

The pair of left and right fastener tapes were prepared, which were provided with the flame retardant polyester fiber uniformly configured at a ratio 25% (a ratio of one per four) and the non-flame retardant polyester fiber configured at a ratio 75% (a ratio of three per four), in the warp, and the non-flame retardant polyester fiber was configured in the weft and thereafter, the coil-shaped fastener elements were sewn to the facing tape side edge portions of both fastener tapes, and as a result, the fastener chain was manufactured.

Further, in the fastener tape of Example 4, one warp in which the flame retardant polyester fiber is inserted and three warps which are adjacent to each other in the width direction of the tape, in which the non-flame retardant polyester fiber is inserted are repeatedly configured in sequence, and as a result, the flame retardant polyester fibers are disposed at a regular interval in the width direction of the tape at the ratio of one per four.

Thereafter, 180° C. thermosetting was performed with respect to the manufactured fastener chain to acquire a fastener chain which is a measurement specimen of Example 4. In this case, a content ratio of the flame retardant polyester fiber to the fastener tape is 12.5% and a content of phosphorus in the fastener tape of Example 4 is 725 ppm.

In Examples 1 to 4, as a method of making phosphorus to be contained in the fastener element, a method in which a monofilament is formed by mixing phosphorus with the polyester resin and the monofilament is molded in the coil shape may be used.

Comparative Example 1

A pair of left and right fastener tapes were prepared, which were provided with the flame retardant phosphorus-copolymerized polyester fiber configured in all warps and wefts and thereafter, the coil-shaped fastener elements were sewn to the facing tape side edge portions of both fastener tapes to manufacture a fastener chain.

Thereafter, 180° C. thermosetting was performed with respect to the manufactured fastener chain to acquire a fastener chain which is a measurement specimen of Comparative Example 1. In this case, a content ratio of the flame retardant polyester fiber to the fastener tape is 100% and a content of phosphorus in the fastener tape of Comparative Example 1 is 5800 ppm.

Comparative Example 2

A pair of left and right fastener tapes were prepared, which were provided with the non-flame retardant polyester fiber configured in all warps and wefts and thereafter, the coil-shaped fastener elements were sewn to the facing tape side edge portions of both fastener tapes to manufacture a fastener chain.

Thereafter, 180° C. thermosetting was performed with respect to the manufactured fastener chain to acquire a fastener chain which is a measurement specimen of Comparative Example 2. In this case, a content ratio of the flame retardant polyester fiber to the fastener tape is 0%.

The respective fastener chains according to Examples 1 to 4 and Comparative Examples 1 and 2 are manufactured with ten fastener chains and thereafter, a combustion distance in horizontal combustion was measured based on U.S. Standard for Flame Retardancy (FMVSS No. 302) in order to evaluate flame retardancy of each fastener chain.

In detail, first, a standard line is granted to a position distant from one tape end of the fastener tape by 38 mm with respect to each fastener chain which becomes a measurement specimen. Continuously, a 5% silicon solution as a combustion promoter is added to each fastener chain and thereafter, the fastener chain was sufficiently dried.

Subsequently, after the dried fastener chain is horizontally held, flame of a gas burner contacts one tape end of the fastener tape for 30 seconds and thereafter, the flame of the gas burner was separated from the tape end. In addition, the combustion distance of the fastener tape was measured with naked eyes by using a ruler based on the standard line granted to the fastener tape.

Herein, when the combustion of the fastener tape reaches the standard line, the standard line was defined as 0 mm and when the combustion of the fastener tape does not reach the standard line, a length of a tape part which is not combusted from the standard line was expressed as a minus mark. Meanwhile, when the combustion of the fastener tape is over the standard line, a length of a tape part which is combusted from the standard line was expressed as a plus mark. In addition, the combustion distance is measured with ten fastener chains with respect to the respective fastener chains according to Examples 1 to 4 and Comparative Examples 1 and 2 to acquire an average of a measurement value of the combustion distance. A result of the acquired average of the combustion distance is illustrated in FIG. 4.

Subsequently, a chain horizontal pull force test was performed with respect to the fastener chains according to Example 1 and Comparative Examples 1 and 2. In the chain horizontal pull force test, first, the fastener chain was held so as not to be released by fixing one end and the other end in the tape length direction of the fastener chain while the left and right fastener elements are coupled to each other. Subsequently, middle portions in the tape length direction of the left and right fastener tapes are clamped with a pair of left and right clampers, and continuously, the left and right clampers that clamp the fastener tape are moved to be separated from each other at a predetermined speed, and as a result, a load was gradually applied to the fastener elements which are coupled to each other. In addition, a chain horizontal pull force of the fastener chain was acquired by measuring a load when the fastener elements are decoupled from each other. Further, the chain horizontal pull force test was performed with ten fastener chains with respect to the fastener chains of Example 1 and Comparative Examples 1 and 2 and an average of the measured chain horizontal pull forces was acquired. As a result, the fastener chain of Example 1 had a chain horizontal pull force of 1019 N as the average and further, the fastener chains of Comparative Examples 1 and 2 had a chain horizontal pull force of 874 N and a chain horizontal pull force of 946 N as the average, respectively.

Figure 4:
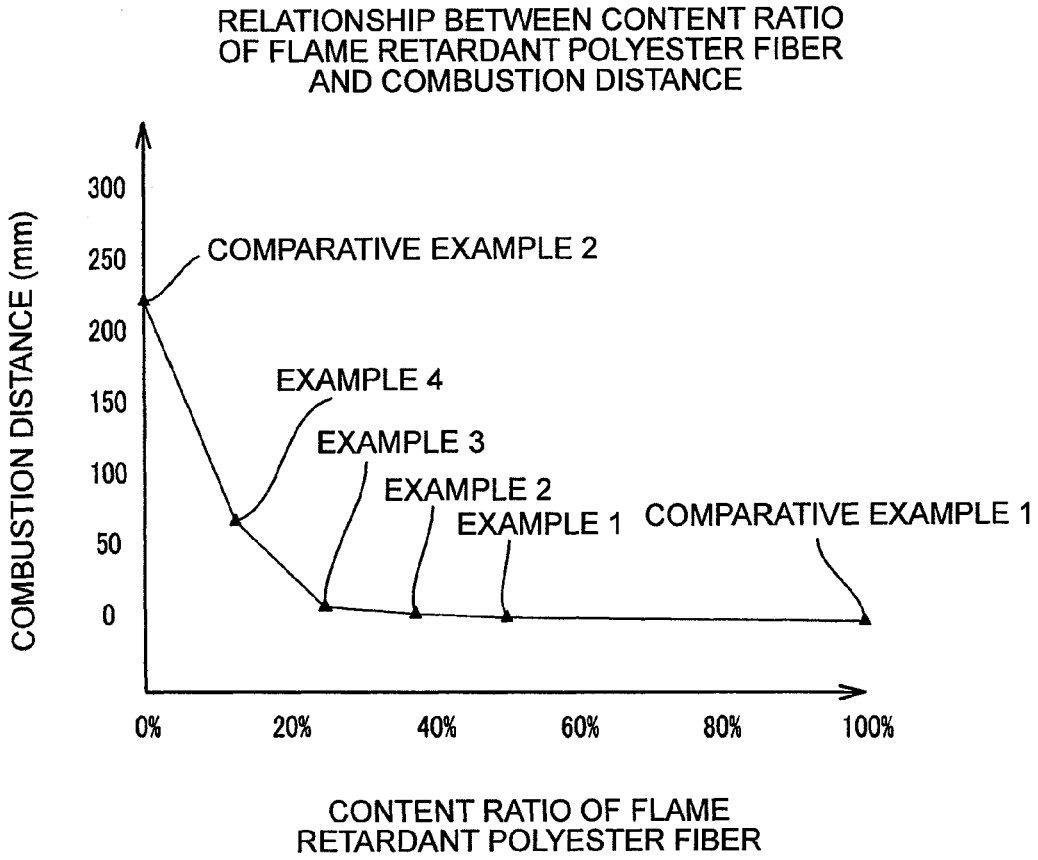
FIG. 4 is a graph illustrating measurement results of flammability of Examples 1 to 4 and Comparative Examples 1 and 2.

First, when the flame retardancies in the fastener chains of Examples 1 to 4 and Comparative Examples 1 and 2 are compared with each other, it could be confirmed that the fastener chains of Examples 1 to 4, in which the flame retardant polyester fiber is configured in at least some of the warps constituting the fastener tape, were smaller in combustion distance than the fastener chain according to Comparative Example 2, in which the flame retardant polyester fiber is not configured at all, as illustrated in FIG. 4 and combustion is prevented by action of phosphorus, and thus it was apparent that the fastener chains of Examples 1 to 4 have flame retardancy.

In particular, it could be confirmed that the fastener chains according to Examples 1 to 3, in which the flame retardant polyester fibers are configured at a ratio of 50% or more to 100% or less of the warps constituting the fastener tape, had approximately the same flame retardancy as the fastener chain according to Comparative Example 2, which has the fastener tape in which the flame retardant polyester fiber is configured in all of the warps and the wefts, regardless of that the non-flame retardant polyester fiber is configured in the weft and had flame retardancy capable of achieving the U.S. Standard for Flame Retardancy (FMVSS No. 302).

Further, when the chain horizontal pull forces in the fastener chains of Example 1 and Comparative Examples 1 and 2 were compared with each other, the fastener chain of Example 1 had a higher chain horizontal pull force than the fastener chain of Comparative Example 2, in which the non-flame retardant polyester fiber is configured in the warp and the weft. In particular, it was confirmed that the chain horizontal pull force of the fastener chain of Example 1 was higher than the chain horizontal pull force of the fastener chain of Comparative Example 1, in which the flame retardant polyester fiber is configured in the warp and the weft, by 10% or more.

It is thought that the reason why the fastener chain of Example 1 has a high chain horizontal pull force is that the non-flame retardant polyester fiber is configured in the weft of the fastener tape and the density of the wefts is increased by heat contraction of the warp, such that the tape strength of the fastener tape is increased and it is difficult for the weft or the warp to be released or cut even when the fastener tape is tensioned in the tape width direction, and further, the interval between the coupling heads of the fastener elements is narrowed due to the heat contraction of the warp, such that the coupling strengths of the left and right fastener elements are increased.

Further, in regard to Examples 1 to 4, the fastener element was configured by the non-flame retardant polyester resin which is not phosphorus-copolymerized to manufacture the fastener chain and the same test as above was performed with respect to the flame retardancy of each acquired fastener chain. As a result, the combustion distance of the fastener chain in which the non-flame retardant fastener element is attached to the flame retardant fastener tape was larger than those of the respective fastener chains of Examples 1 to 4 which have the flame retardant fastener element, but smaller than that of the fastener chain according to Comparative Example 2. Therefore, in regard to Examples 1 to 4, even when the fastener element is made of the non-flame retardant polyester resin, it could be confirmed that combustion is prevented by action of phosphorus, and thus it can be said that the fastener chains of Examples 1 to 4 have flame retardancy.

DESCRIPTION OF REFERENCE NUMERALS

1 Slide fastener
2 Fastener chain
6 Slider
7 Upper stopper
8 Lower stopper
10 Fastener tape
11 Tape main body
11*a* First main body area
11*b* Second main body area
12 Tape side edge portion
15 Warp
16 Weft
17 Flame retardant polyester fiber
18 Non-flame retardant polyester fiber
20 Element row
21 Fastener element
22 Stitching thread
23 Core thread
30 Fastener tape
31 Tape main body
31*a* First main body area
31*b* Second main body area
32 Tape side edge portion
35 Warp
36 Weft
37 Flame retardant polyester fiber
38 Non-flame retardant polyester fiber

The invention claimed is:

1. A fastener chain in which a continuous fastener element is attached to facing tape side edge portions of a pair of left and right woven fastener tapes, wherein:

each of the left and right woven fastener tapes include a plurality of warps and a weft;

at least some of the warps include a flame retardant phosphorus-copolymerized polyester fiber, and the weft includes a synthetic resin having a higher tensile strength than that of the flame retardant phosphorus-copolymerized polyester fiber, wherein the synthetic resin is not flame retardant and not phosphorus-copolymerized.

2. The fastener chain according to claim 1, wherein:

50% to 100% of the warps include the flame retardant phosphorus-copolymerized polyester fiber.

3. The fastener chain according to claim 1, wherein:

the flame retardant phosphorus-copolymerized polyester fibers are disposed in a tape width direction at a regular interval.

4. The fastener chain according to claim 1, wherein:

the flame retardant phosphorus-copolymerized polyester fiber has a thicker line diameter than the weft.

5. The fastener chain according to claim 1, wherein:

the tensile strength of the weft is 3.5 cN/dtex or more.

6. The fastener chain according to claim 1, wherein:

the fastener element is made of a flame retardant phosphorus-copolymerized synthetic resin.

7. The fastener chain according to claim 1, wherein:

a flame retardant containing phosphorus is attached to the fastener element.

8. A slide fastener including the fastener chain according to claim 1.

* * * * *